United States Patent [19]

Hughes

[11] 4,153,189

[45] May 8, 1979

[54] CARRIER FOR CLOTHES HANGERS

[76] Inventor: Allan F. Hughes, 1356 Bay Terr., North Bay Village, Fla. 33141

[21] Appl. No.: 866,412

[22] Filed: Jan. 3, 1978

[51] Int. Cl.[2] ..... B65D 71/00

[52] U.S. Cl. ..... 224/45 T; 224/42.46 A; 2/DIG. 6

[58] Field of Search ..... 224/45 T, 54, 55, 56, 224/57, 49, 58, 4 D, 29 C, 42.1 CA, 42.45 A, 42.46 A, 45 R, 45 P; 2/DIG. 6; 24/204

[56] References Cited

U.S. PATENT DOCUMENTS

| | | | |
|---|---|---|---|
| 584,133 | 6/1897 | McIntire | 294/26 X |
| 641,340 | 1/1900 | Smith | 224/45 P |
| 1,299,390 | 4/1919 | Swanson | 16/114 UX |
| 1,335,888 | 4/1920 | Fulton | 224/56 |
| 1,720,013 | 7/1929 | Stone | 224/45 T UX |
| 1,880,963 | 10/1932 | Kraft | 16/114 UX |
| 2,357,309 | 9/1944 | Brown et al. | 224/45 T UX |
| 2,401,399 | 6/1946 | Akers | 16/114 |
| 3,554,417 | 1/1971 | Yorty | 224/45 T |
| 3,612,260 | 10/1971 | Brilhart | 224/45 T X |
| 3,744,600 | 7/1973 | Belland et al. | 224/45 T X |

OTHER PUBLICATIONS

Velcro Corporation, (Publication), Sep. 1972.

*Primary Examiner*—Robert J. Spar
*Assistant Examiner*—Jerold M. Forsberg
*Attorney, Agent, or Firm*—Brumbaugh, Graves, Donohue & Raymond

[57] ABSTRACT

A carrier for clothes on hangers which is comprised of a C-shaped gripping bar, one arm of which terminates in a closed loop through which the hook portions of clothes hangers can be attached. A flexible strap attached to the loop is used to secure the hangers in the loop.

1 Claim, 5 Drawing Figures

FIG.3
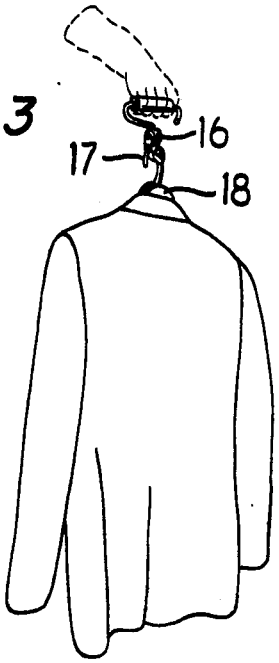
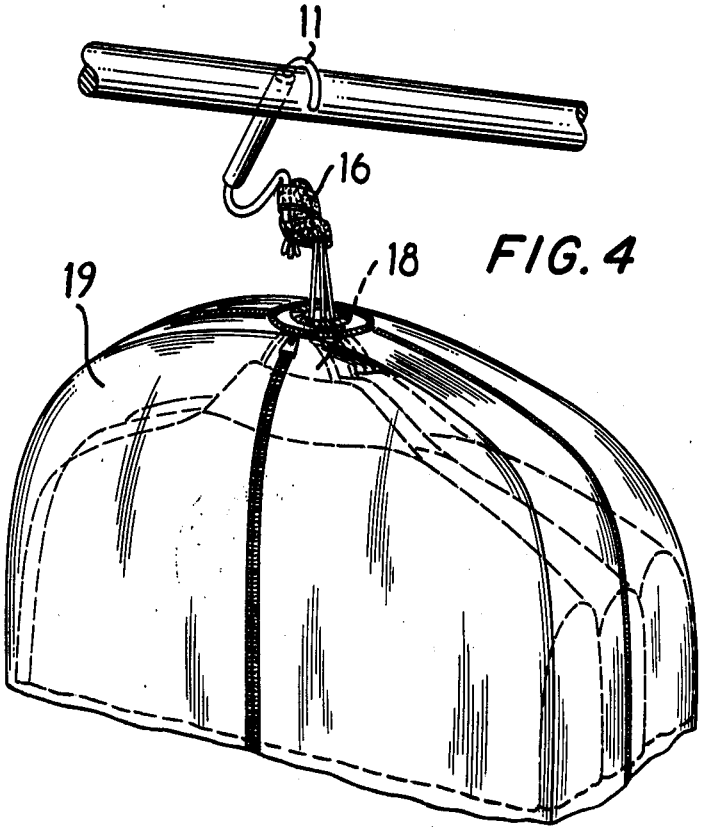
FIG. 4
FIG. 5
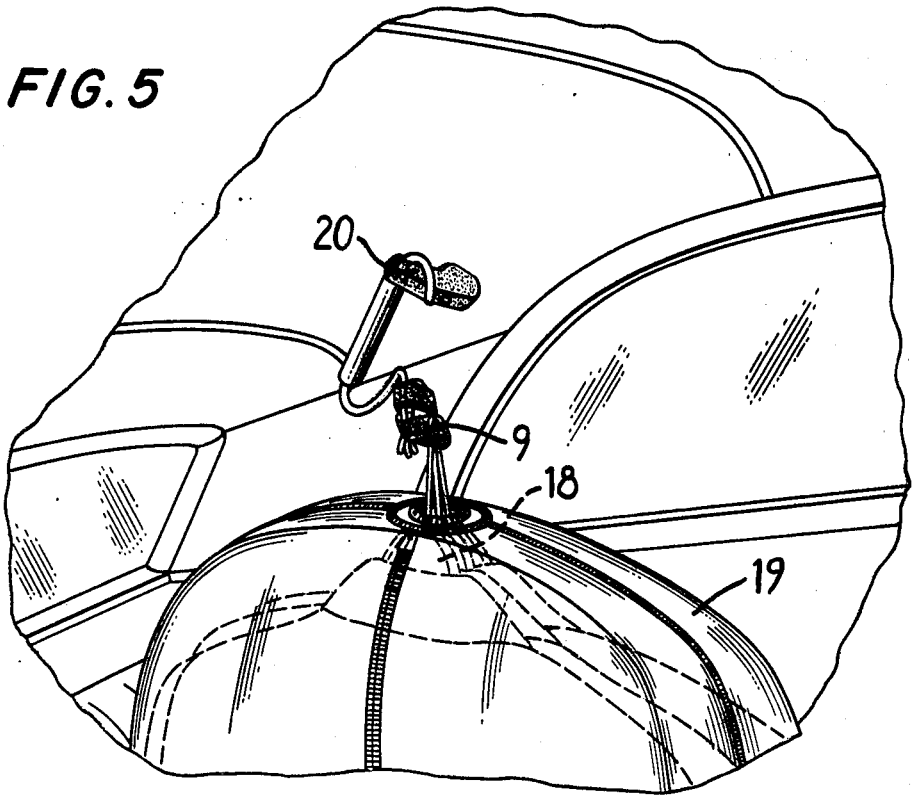

CARRIER FOR CLOTHES HANGERS

BACKGROUND OF THE INVENTION

This invention relates to a carrier for clothes on hangers. It is intended to make it easier to carry and transport clothes on hangers, or garment bags containing clothes on hangers, as well as to provide a convenient method for hanging them in closets, on racks or on hooks in vehicles.

In traveling it is often necessary to carry coat hangers laden with clothes to and from the airport, bus terminal or train station. The loose hangers are difficult to collect, to keep track of and to place on a rack or hook. In addition, the weight of the clothes makes it uncomfortable and difficult to hand carry the hangers. Thus the hook of a conventional coat hanger is narrow and painfully constricts and cuts into a person's hand if clothes are carried on hangers for any length of time. An alternative to carrying a heavy collection of hangers by the hanger hooks is for the traveler to drape the clothing over his arm. This method is awkward and defeats the purpose of hanging the clothes on hangers, since this method wrinkles the clothes.

U.S. Pat. No. 2,629,529 to Threeton attempted to solve this problem with a suit carrier which was designed to be carried over the shoulder. This device is a flat stiff piece of metal with a hook on one end for hanging the carrier, a flat carrying handle attached across the metal surface of the plate, and a piece of ball type chain attached across the plate to which suits can be attached. Threeton's carrier is complicated, requires several more parts than the present invention and does not function in the simple, straightforward and advantageous manner of the present invention.

SUMMARY OF THE INVENTION

The present invention is directed to a convenient device for carrying and storing clothing on hangers. The carrier includes a C-shaped gripping bar in which one arm of the C terminates in a closed loop with a flexible strap attached to it. The loop is designed so that the hooked ends of coat hangers can pass through it and be secured in place by wrapping the flexible strap around both the loop and the hangers thus making it possible, if necessary, to drape the clothing over the person's arm without having the hangers come loose from the carrier. The opposite end of the C-shaped gripping bar forms a hook which allows the carrier to hang conveniently on a rack or hook in airplanes, trains, buses, cars or closets without further adjustments or changes, or danger of misplacing loose hangers.

DESCRIPTION OF THE DRAWINGS

The invention will be more fully understood when the description is read in conjunction with the accompanying drawings, in which:

FIG. 3 shows the carrier in use transporting a suit on a hanger;

FIG. 4 shows the carrier in its hanging position on a rack and supporting several hangers and a garment bag; and FIG. 5 shows the carrier hanging from a clothing hook inside a car with several suits.

DETAILED DESCRIPTION OF THE INVENTION

Figure 1:
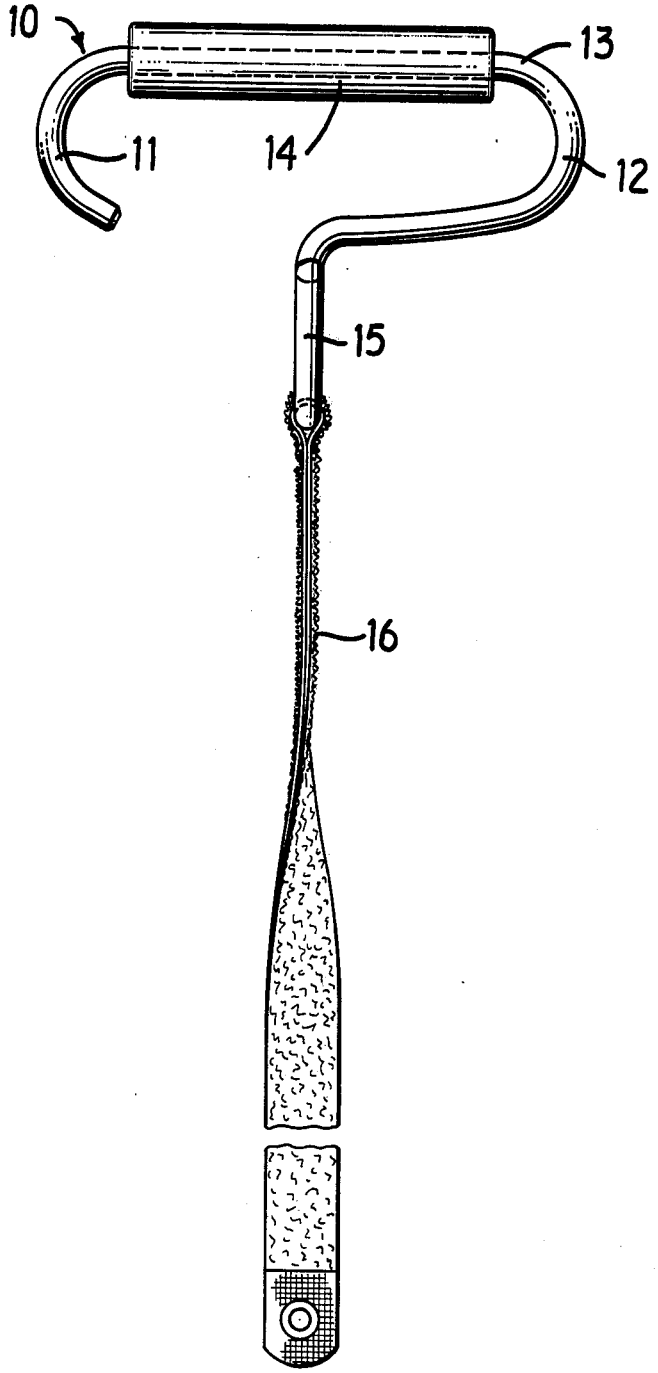
FIG. 1 is a plan view of the carrier.
Figure 2:
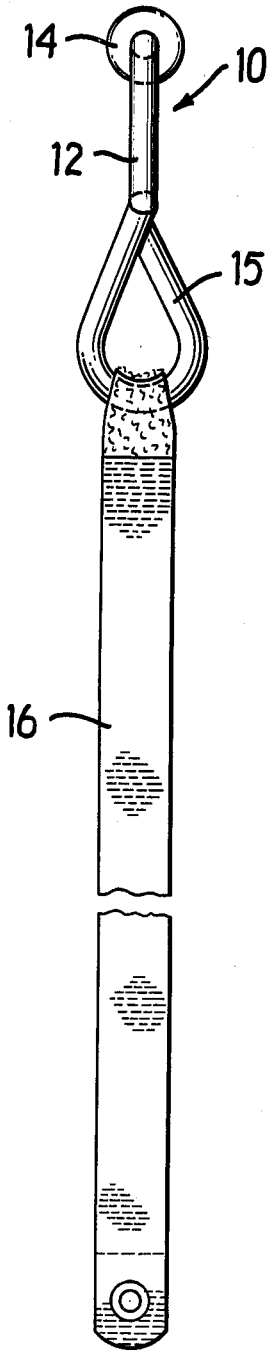
FIG. 2 is a side elevation view of the carrier of FIG. 1.

Referring now to the drawings, the carrier of the present invention, as illustrated in FIGS. 1 and 2, comprises a C-shaped gripping bar 10 formed by curved arms 11 and 12 joined by an elongated portion 13. A rotatable handle 14, formed of a suitable material to make the carrier more comfortable to hold and carry, can be provided on the elongated portion 13, shown in FIG. 1 as a straight section but which can, if desired, be bent to conform to the hand. The handle 14 is allowed to rotate on the elongated portion 13 in order to prevent chafing of the hand due to friction. The arm 12 terminates in a loop 15 bent to lie in a plane perpendicular to the plane of the C-shaped bar 10. The C-shaped bar 10 is preferably made of metal although suitable plastic or other material can be used.

A flexible strap 16 is fastened to the loop 15 and used to secure hooks 17 of clothes hangers 18 in place on the loop 15 by wrapping it around the loop and hangers as shown in FIGS. 3, 4 and 5. The strap can be made of leather, cloth or any other suitable material, but the preferred material is a double faced strap made of a commercially available flexible tape fastener sold under the trade name "VELCRO".

Tape fasteners have been developed for use as fastening straps, as exemplified in U.S. Pat. No. 3,000,384. The fasteners include two mating strips of fabric tape, one of which, hereinafter referred to as the "hook gender" tape, has an operative surface bristling with a multitude of small, upstanding monofilament hooks or hooking elements, and the other, hereinafter referred to as the "loop gender" tape, has an operative surface faced with a napped pile of fine threads or holding elements. When the two tapes are brought together, the hooks embed themselves in the pile, engaging the loops of thread to provide a fastener capable of withstanding shear forces as great as 20 pounds per square inch, yet the tapes separate easily when peeled apart. Moreover, they can be subjected to opening-closing cycles repeatedly without loss of strength or sign of wear. A more thorough exposition of the structure, manufacture, and use of tape fasteners is found in U.S. Pat. No. 3,009,235. The strap 16 shown in FIG. 1 is a double faced tape, one side having the "hook gender" tape and the other side having the "loop gender" tape so that it can fasten on to itself.

In using the inventive carrier, the hooks 17 of the coat hangers 18 are passed through the loop 15, and then the flexible strap 16 is wrapped around the hooks and loop in order to secure the hangers to the carrier, all as shown in FIGS. 3, 4 and 5, and with the clothing in a garment bag 19 (FIGS. 4 and 5). The clothes and garment bag may then be readily transported by grasping the handle 14 or, if necessary, may be draped over the person's arm without having the hangers come loose from the carrier. When it is desired to store the clothes on a closet bar, the hook 11 of the carrier is placed on the bar as shown in FIG. 4. With the loop 15 perpendicular to the C-shaped gripping bar 10, the clothing is properly aligned in the closet. In the event the clothes must be transported in an automobile, the hook 11 of the carrier is positioned over a hook 20, ordinarily found in the rear passenger compartment, as shown in FIG. 5. Note that when the carrier is used to hang the clothes in a closet or on a hook in a home, automobile, plane or bus, with the hook 11 in proper position the gripping bar 13 swings down and does not impede the use of the carrier.

While the invention has been particularly shown and described with reference to a preferred embodiment, it will be understood by those skilled in the art that various changes in form and details may be made therein without departing from the spirit and scope of the invention.

I claim:

1. A carrier for clothing on hangers comprising a C-shaped gripping bar having an elongated and substantially straight portion, a rotatable handle on the straight portion of the gripping bar, a closed loop on one end of the C-shaped bar formed by bending the end of the bar and lying in a plane perpendicular to the plane of the C-shaped bar, the loop adapted to receive hanger hooks, a flexible strap attached to the loop for wrapping around the loop and hangers to secure the hanger hooks to the loop, the flexible strap including hooking elements made of flexible resilient material on one face and holding elements for the hooking elements comprising loops of flexible material on the other face so that when the two faces are pressed together they will adhere to each other to assist in securing the hanger hooks to the loop, a hook formed in the C-shaped bar at its other end and adapted to be placed on supporting bars or hooks, whereby the gripping bar may readily be grasped for carrying clothing supported by the hangers.

* * * * *